US010837474B2

(12) United States Patent
Kadiyala

(10) Patent No.: US 10,837,474 B2
(45) Date of Patent: Nov. 17, 2020

(54) AIRCRAFT HYDRAULIC FLUID HEATING SYSTEM AND METHOD

(71) Applicant: AIRBUS GROUP INDIA PRIVATE LIMITED, Bangalore (IN)

(72) Inventor: Kiran Kumar Kadiyala, Bangalore (IN)

(73) Assignee: Airbus Group India Private Limited, Bangalore (IN)

( * ) Notice: Subject to any disclaimer, the term of this patent is extended or adjusted under 35 U.S.C. 154(b) by 1137 days.

(21) Appl. No.: 14/840,073

(22) Filed: Aug. 31, 2015

(65) Prior Publication Data

US 2016/0069362 A1 Mar. 10, 2016

(30) Foreign Application Priority Data

Sep. 9, 2014 (IN) ..... 4422/CHE/2014

(51) Int. Cl.

| | |
|---|---|
| ***F15B 21/04*** | (2019.01) |
| ***F15B 21/042*** | (2019.01) |
| ***F24H 9/20*** | (2006.01) |
| *F24H 1/00* | (2006.01) |

(52) U.S. Cl.

CPC ..... *F15B 21/042* (2013.01); *F24H 9/2014* (2013.01); *F24H 9/2021* (2013.01); *F15B 2211/50518* (2013.01); *F15B 2211/5157* (2013.01); *F15B 2211/526* (2013.01); *F15B 2211/6343* (2013.01); *F24H 1/0018* (2013.01)

(58) Field of Classification Search

CPC .... F24H 9/2021; F24H 9/2014; F15B 21/042; B64C 13/40

See application file for complete search history.

(56) References Cited

U.S. PATENT DOCUMENTS

| | | | | |
|---|---|---|---|---|
| 9,169,829 | B2 * | 10/2015 | Nomaguchi | F03D 7/02 |
| 2012/0025015 | A1 * | 2/2012 | Ito | B64F 5/60 244/99.6 |

* cited by examiner

*Primary Examiner* — Abiy Teka

(74) *Attorney, Agent, or Firm* — Jenkins, Wilson, Taylor & Hunt, P.A.

(57) ABSTRACT

An aircraft hydraulic fluid heating system and method are disclosed. In one embodiment, pump characteristics of a hydraulic pump coupled to a reservoir are obtained. Further, total demand of the hydraulic fluid for hydraulically controlled flight controls in the aircraft is determined. Furthermore, the hydraulic fluid in the reservoir is dynamically heated based on the pump characteristics and the total demand of the hydraulic fluid.

9 Claims, 5 Drawing Sheets

AIRCRAFT HYDRAULIC FLUID HEATING SYSTEM AND METHOD

RELATED APPLICATIONS

Benefit is claimed under 35 U.S.C. 119(a)-(d) to Foreign application Serial No. 4422/CHE/2014 filed in India entitled "AIRCRAFT HYDRAULIC FLUID HEATING SYSTEM AND METHOD", on Sep. 9, 2014, by AIRBUS GROUP INDIA PRIVATE LIMITED, which is herein incorporated in its entirety by reference for all purposes.

TECHNICAL FIELD

Embodiments of the present subject matter generally relate to hydraulic fluid in aircrafts, and more particularly, to heating the hydraulic fluid in the aircrafts.

BACKGROUND

Typically, an aircraft includes a hydraulic circuit having a reservoir to supply hydraulic fluid to various flight controls. Exemplary flight controls include rudders, valves, flaps, ailerons and the like. Generally, the hydraulic fluid in the hydraulic circuit is heated to a predefined temperature to decrease viscosity of the hydraulic fluid. Existing methods for heating the hydraulic fluid may use air from an aircraft engine or specialized heating elements, such as thermal control valves in the hydraulic circuit. The heating elements are distributed at various locations in the hydraulic circuit for maintaining temperature of the hydraulic fluid at the predefined temperature. However, the distribution of the heating elements may increase the complexity of the hydraulic circuit.

SUMMARY

An aircraft hydraulic fluid heating system and method are disclosed. According to one aspect of the present subject matter, pump characteristics of a hydraulic pump coupled to a reservoir are obtained. Further, total demand of the hydraulic fluid for hydraulically controlled flight controls in the aircraft is determined. Furthermore, the hydraulic fluid in the reservoir is dynamically heated based on the pump characteristics and the total demand of the hydraulic fluid.

According to another aspect of the present subject matter, the system includes an electrically controlled pressure relief valve. Further, a reservoir is coupled to the electrically controlled pressure relief valve. Furthermore, a hydraulic pump is coupled to the reservoir. In addition, one or more hydraulically controlled flight controls are coupled to the reservoir via the hydraulic pump. Moreover, a hydraulic control system is coupled to the electrically controlled pressure relief valve. Also, the hydraulic control system includes a hydraulic fluid temperature control engine. In one embodiment, the hydraulic fluid temperature control engine includes instructions to perform the method described above.

According to yet another aspect of the present subject matter, a non-transitory computer-readable storage medium for heating the hydraulic fluid in the reservoir of the aircraft, having instructions that, when executed by a computing device causes the computing device to perform the method described above.

The system and method disclosed herein may be implemented in any means for achieving various aspects. Other features will be apparent from the accompanying drawings and from the detailed description that follow.

BRIEF DESCRIPTION OF THE DRAWINGS

Various embodiments are described herein with reference to the drawings, wherein.

The drawings described herein are for illustration purposes only and are not intended to limit the scope of the present disclosure in any way.

DETAILED DESCRIPTION

In the following detailed description of the embodiments of the present subject matter, references are made to the accompanying drawings that form a part hereof, and in which are shown by way of illustration specific embodiments in which the present subject matter may be practiced. These embodiments are described in sufficient detail to enable those skilled in the art to practice the present subject matter, and it is to be understood that other embodiments may be utilized and that changes may be made without departing from the scope of the present subject matter. The following detailed description is, therefore, not to be taken in a limiting sense, and the scope of the present subject matter is defined by the appended claims.

Embodiments described herein provide methods and systems for heating hydraulic fluid in a reservoir of an aircraft. The proposed technique obtains pump characteristics of a hydraulic pump coupled to the reservoir and total demand of the hydraulic fluid for hydraulically controlled flight controls in the aircraft. Further, a pressure of an electrically controlled pressure relief valve is set based on the pump characteristics, the total flow demand of the hydraulic fluid and the temperature states of the system. For example, the electrically controlled pressure relief valve is connected close to the reservoir. Furthermore, the hydraulic fluid is heated to a predefined temperature by passing the hydraulic fluid through the electrically controlled pressure relief valve at the set pressure.

Figure 1:
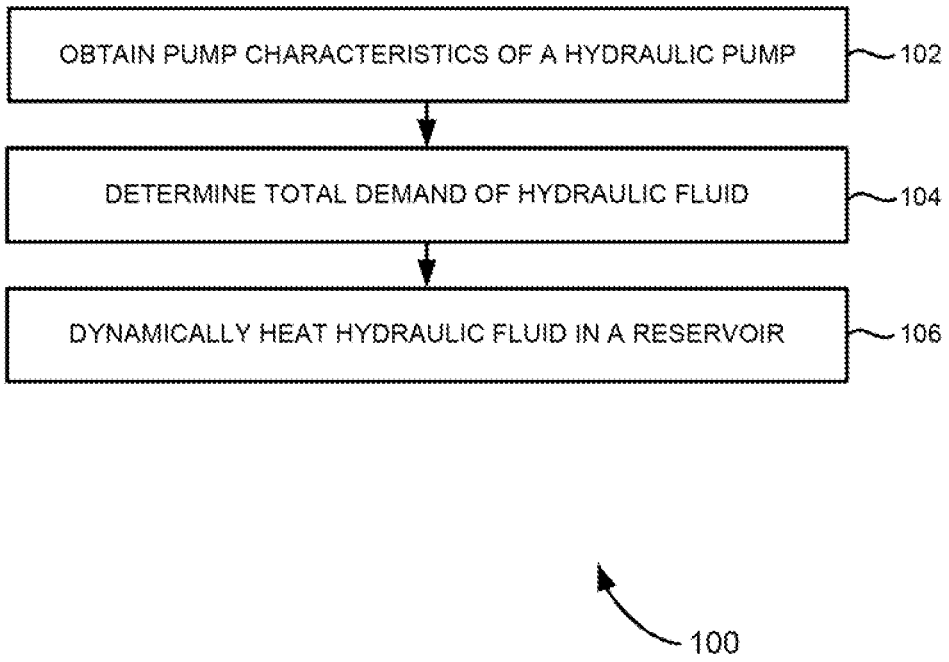
FIG. 1 is a flow diagram illustrating an exemplary method for heating hydraulic fluid in a reservoir of an aircraft, according to one embodiment.
Figure 4:
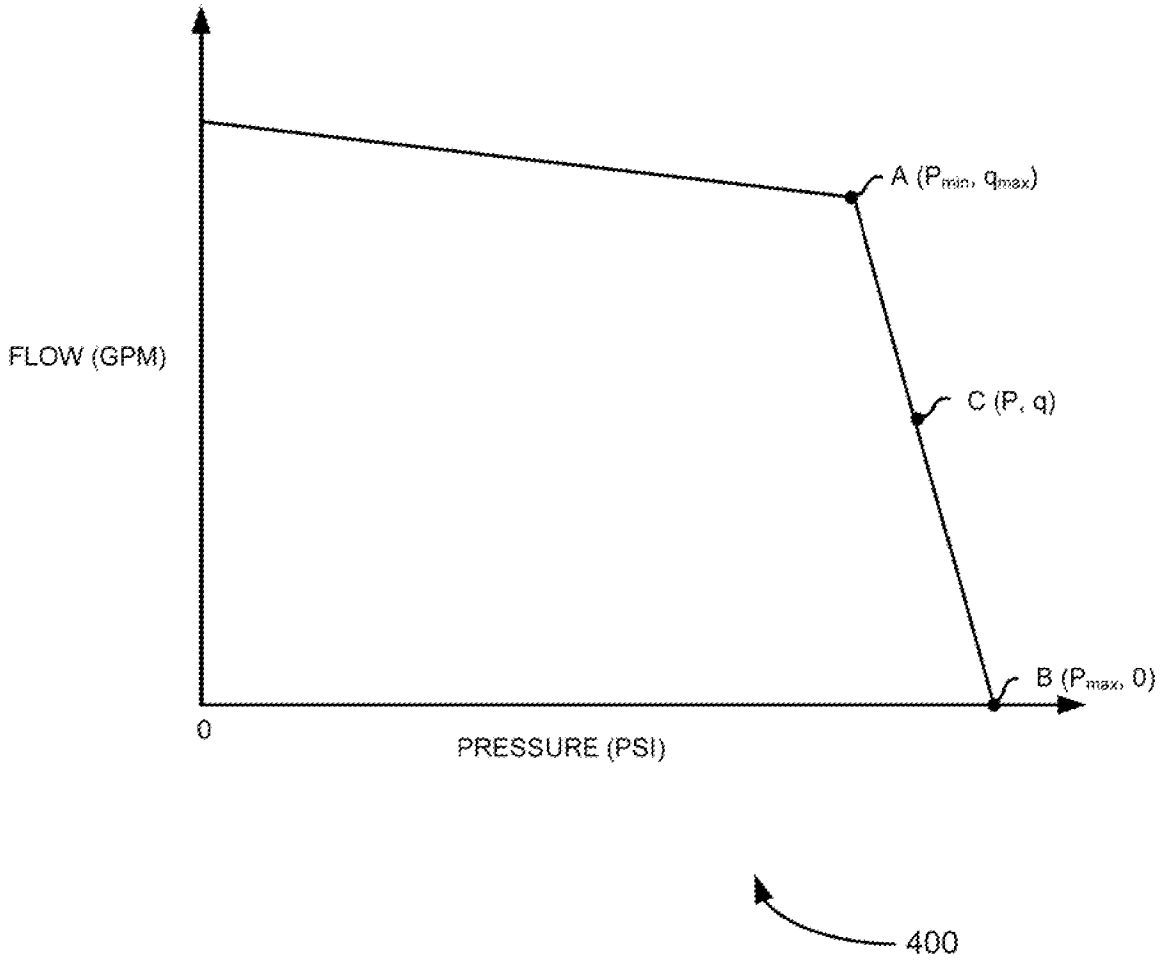
FIG. 4 illustrates exemplary pump characteristics of a hydraulic pump coupled to the reservoir of the aircraft, according to one embodiment.

FIG. 1 is a flow diagram 100 illustrating an exemplary method for heating hydraulic fluid in a reservoir of an aircraft, according to one embodiment. At step 102, pump characteristics of a hydraulic pump coupled to the reservoir are obtained. For example, the pump characteristics include a pressure versus flow graph associated with the hydraulic pump. Exemplary pump characteristics of the hydraulic pump are illustrated in FIG. 4. At step 104, total demand of the hydraulic fluid for hydraulically controlled flight controls in the aircraft are determined. Exemplary flight controls which are hydraulically controlled include rudders, valves, ailerons, flaps and the like. For example, total demand of the hydraulic fluid is the amount of hydraulic fluid currently utilized by the hydraulically controlled flight controls in the aircraft.

At step 106, the hydraulic fluid in the reservoir is dynamically heated based on the pump characteristics and the total demand of the hydraulic fluid. In one embodiment, a pressure of an electrically controlled pressure relief valve is set based on the pump characteristics and the total demand of the hydraulic fluid. In this embodiment, a current temperature of the hydraulic fluid, a predefined temperature of the hydraulic fluid to be maintained and a volume of the hydraulic fluid in the reservoir are determined. Further, an energy required for heating the hydraulic fluid is computed based on the current temperature of the hydraulic fluid, the predefined temperature of the hydraulic fluid to be maintained and the volume of the hydraulic fluid in the reservoir. Furthermore, an operating point for the electrically controlled pressure relief valve is determined to meet the computed energy required for heating the hydraulic fluid based on the pump characteristics and the total demand of the hydraulic fluid. In addition, the pressure of the electrically controlled pressure relief valve is set based on the operating point.

Further in this embodiment, the hydraulic fluid in the reservoir is dynamically heated by passing the hydraulic fluid through the electrically controlled pressure relief valve at the set pressure. For example, the hydraulic fluid in the reservoir is dynamically heated to the predefined temperature by passing the hydraulic fluid through the electrically controlled pressure relief valve at the set pressure.

Figure 2:
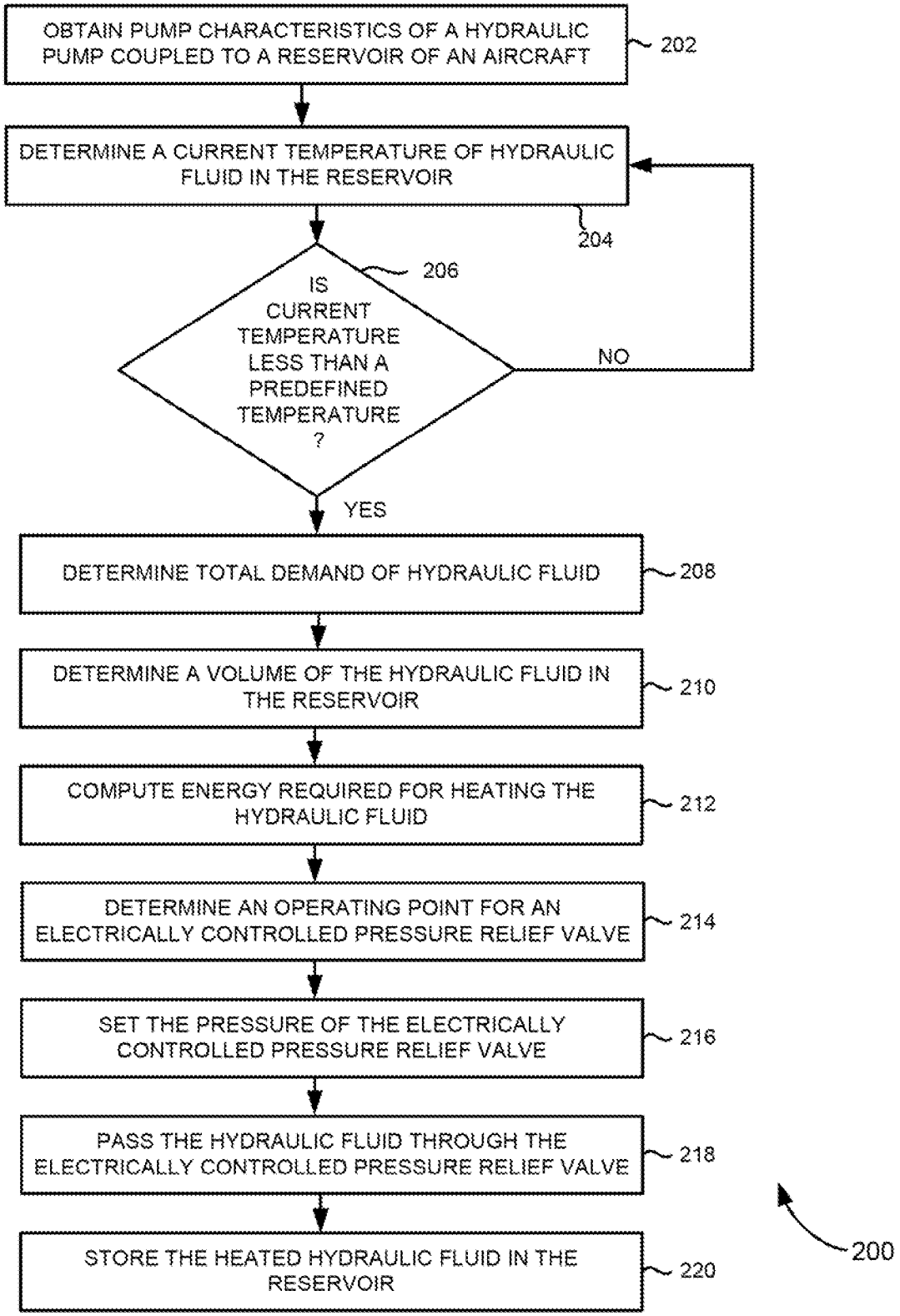
FIG. 2 is another flow diagram illustrating a detailed method for heating the hydraulic fluid in the reservoir of the aircraft, according to one embodiment.

Referring now to FIG. 2, which is another flow diagram 200 illustrating a detailed method for heating hydraulic fluid in a reservoir of an aircraft, according to one embodiment. At step 202, pump characteristics of a hydraulic pump coupled to the reservoir are obtained. Exemplary pump characteristics of the hydraulic pump are illustrated in FIG. 4. At step 204, a current temperature of the hydraulic fluid in the reservoir ($T_r$) of the aircraft is determined. At step 206, it is determined whether $T_r$ is less than a predefined temperature ($T_t$). $T_t$ is a temperature at which the hydraulic fluid in the reservoir of the aircraft is to be maintained. If it is determined that $T_r$ is less than $T_t$, then at step 208, total demand of the hydraulic fluid ($q_f$) for hydraulically controlled flight controls in the aircraft are determined. Exemplary flight controls which are hydraulically controlled include rudders, valves, ailerons, flaps and the like.

At step 210, a volume of the hydraulic fluid in the reservoir ($V_r$) is determined. At step 212, energy required for heating the hydraulic fluid to $T_t$ is computed based on the determined $T_r$, $T_t$ and $V_r$. For example, the energy required can be expressed as:

$$\text{Energy required}=\rho_f V_r C_r (T_t - T_r) \tag{1}$$

wherein, $\rho_f$ is a density of the hydraulic fluid; and $C_r$ is a specific heat capacity of the reservoir.

In one embodiment, a maximum time ($t_h$) for heating the hydraulic fluid from $T_r$ to $T_t$ is determined based on the $q_f$. For example, $t_h$ is determined experimentally. Further, a power requirement for heating the hydraulic fluid in $t_h$ is obtained as:

$$\text{Power requirement}=\frac{\text{Energy required}}{t_h} \tag{2}$$

Substituting the equation (1) in the equation (2), the power requirement is obtained as:

$$\text{Power requirement}=\frac{\rho_f V_r C_r (T_t - T_r)}{t_h} \tag{3}$$

At step 214, an operating point for an electrically controlled pressure relief valve is determined, to meet the computed power requirement for heating the hydraulic fluid, based on the pump characteristics, shown in FIG. 4, and $q_f$. The operating point (e.g., point C on the pump characteristics, shown in FIG. 4) provides a pressure setting of the electrically controlled pressure relief valve (P) and a flow through the electrically controlled pressure relief valve (q) to generate the power required for heating the hydraulic fluid from $T_r$ to $T_t$. Therefore, the power requirement can also be expressed as:

$$\text{Power requirement}=P*q \tag{4}$$

Substituting the equation (3) in the equation (4), q is obtained as:

$$q=\frac{\rho_f V_r C_r (T_t - T_r)}{t_h P} \tag{5}$$

Further, a total flow through the hydraulic pump ($q_t$) can be expressed as:

$$q_t=q_f+q \tag{6}$$

In one example, $q_t$ can be determined from the pump characteristics of the hydraulic pump using equation:

$$q_t = 2\frac{q_{max}(P-P_{max})}{P_{min}-P_{max}} \tag{7}$$

wherein, $q_{max}$ is the maximum flow through the hydraulic pump obtained from the pump characteristics, shown in FIG. 4; and $P_{min}$ and $P_{max}$ are the minimum and maximum pressure, respectively, of the hydraulic pump obtained from the pump characteristics, shown in FIG. 4.

Substituting the equations (5) and (7) in the equation (6) would result in:

$$2\frac{q_{max}(P-P_{max})}{P_{min}-P_{max}} = q_f + \frac{\rho_f V_r C_r (T_t - T_r)}{t_h P} \tag{8}$$

Rearranging the equation (8), P is obtained as:

$$P^2 - \left[P_{max} + \frac{q_f(P_{min}-P_{max})}{2q_{max}}\right]P - \left[\frac{P_{min}-P_{max}}{2q_{max}}\right]\left[\frac{\rho_f V_r C_r (T_t - T_r)}{t_h}\right] = 0 \tag{9}$$

At step 216, the pressure of the electrically controlled pressure relief valve is set to P which is determined using the equation (9). At step 218, the hydraulic fluid in the reservoir is heated by passing the hydraulic fluid through the electrically controlled pressure relief valve at the set pressure. At step 220, the heated hydraulic fluid is stored in the reservoir of the aircraft. Referring back to step 204, if it is determined that the $T_r$ is not less than $T_t$, then the process is repeated from the step 204 to maintain the temperature of the hydraulic fluid in the reservoir at $T_t$.

Figure 3:
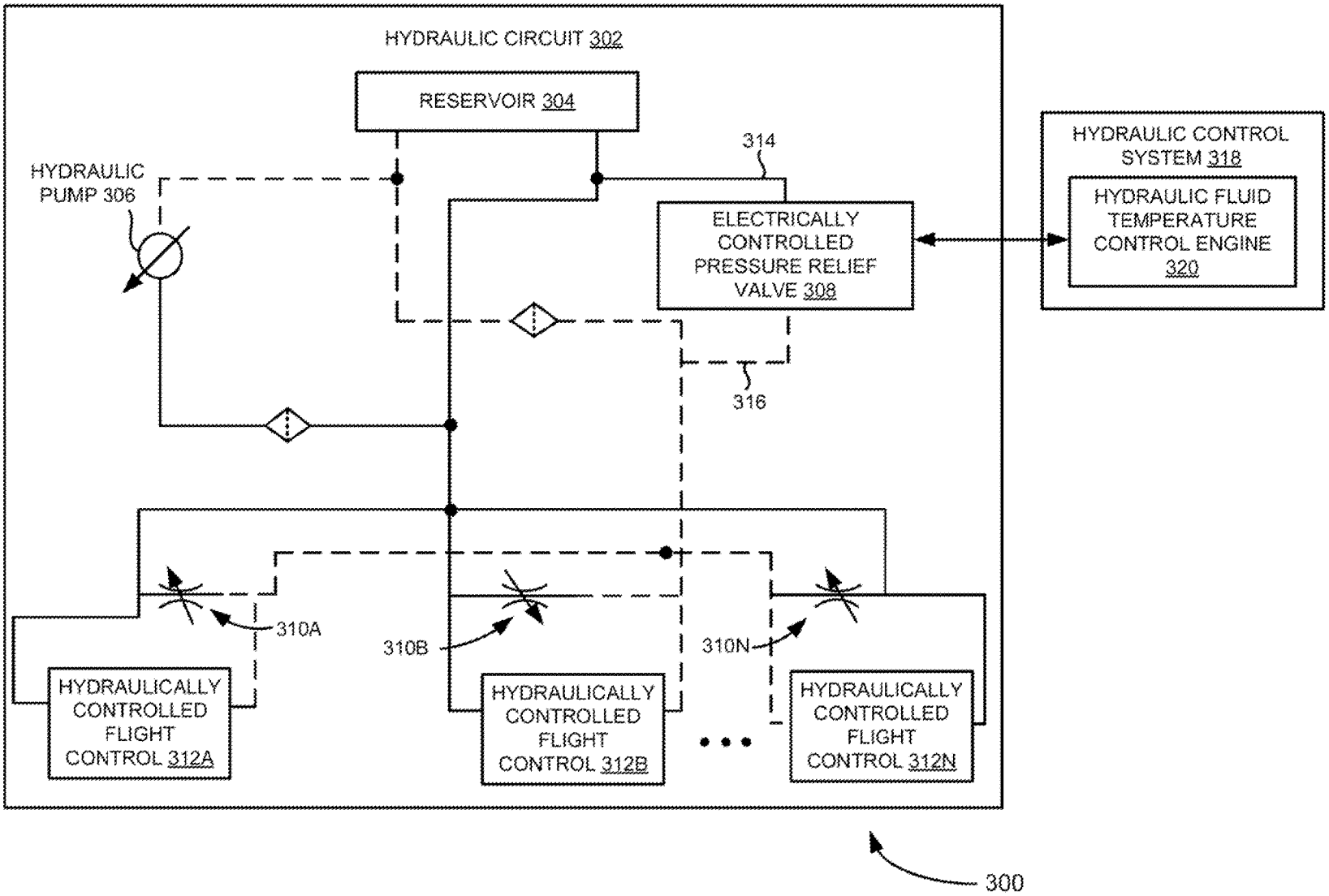
FIG. 3 is an exemplary schematic of an aircraft hydraulic fluid heating system, according to one embodiment.

Referring now to FIG. 3, which is an exemplary schematic of an aircraft hydraulic fluid heating system 300, according to one embodiment. As shown in FIG. 3, the aircraft hydraulic fluid heating system 300 includes a hydraulic circuit 302 and a hydraulic control system 318. Further as shown in FIG. 3, the hydraulic circuit 302 includes a reservoir 304, a hydraulic pump 306, an electrically controlled pressure relief valve 308, flushing orifices 310A-310N and hydraulically controlled flight controls 312A-312N. Furthermore as shown in FIG. 3, the hydraulic control system 318 includes a hydraulic fluid temperature control engine 320.

Moreover as shown in FIG. 3, the reservoir 304 is coupled to the electrically controlled pressure relief valve 308 and the hydraulic pump 306. In addition as shown in FIG. 3, the flushing orifices 310A-310N are coupled to the hydraulic pump 306. Also as shown in FIG. 3, the flushing orifices 310A-310N are associated with the hydraulically controlled flight controls 312A-312N, respectively. Further as shown in FIG. 3, the electrically controlled pressure relief valve 308 is communicatively connected to the hydraulic control system 318. Particularly, the electrically controlled pressure relief valve 308 is communicatively connected to the hydraulic fluid temperature control engine 320. The hydraulic fluid temperature control engine 320 in the hydraulic control system 318 represents any combination of circuitry and executable instructions. Also as shown in FIG. 3, the dotted line 316 indicates a low pressure pipeline and the solid line 314 indicates a high pressure pipeline.

In operation, the hydraulic fluid temperature control engine 320 obtains pump characteristics of the hydraulic pump 306. Further, the hydraulic fluid temperature control engine 320 determines a current temperature of the hydraulic fluid in the reservoir 304. If the current temperature of the hydraulic fluid is less than a predefined temperature, then the hydraulic fluid temperature control engine 320 determines a total demand of the hydraulic fluid for the hydraulically controlled flight controls 312A-312N. The total demand of the hydraulic fluid is the amount of hydraulic fluid currently utilized by the hydraulically controlled flight controls 312A-312N. The hydraulic fluid temperature control engine 320 then determines a time $t_h$, based on the total demand of the hydraulic fluid, within which the hydraulic fluid may be heated. In other words, a rate at which the hydraulic fluid can be heated by the electrically controlled pressure relief valve 308 is determined based on the total demand of the hydraulic fluid.

Furthermore, the hydraulic fluid temperature control engine 320 determines a volume of the hydraulic fluid in the reservoir 304. In addition, the hydraulic fluid temperature control engine 320 computes an energy required for heating the hydraulic fluid, within the time $t_h$, based on the current temperature of the hydraulic fluid, the predefined temperature of the hydraulic fluid to be maintained and the volume of the hydraulic fluid in the reservoir 304. This is explained in detail with reference to FIG. 2.

Moreover, the hydraulic fluid temperature control engine 320 determines an operating point for the electrically controlled pressure relief valve 308 to meet the computed energy required for heating the hydraulic fluid based on the pump characteristics and the total demand of the hydraulic fluid. This is explained in detail with reference to FIG. 2. Also, the hydraulic fluid temperature control engine 320 sets the pressure of the electrically controlled pressure relief valve 308 using the operating point. For example, the hydraulic fluid temperature control engine 320 sets the pressure by sending an electrical signal to the electrically controlled pressure relief valve 308.

In addition in operation, upon setting the pressure of the electrically controlled pressure relief valve 308, the hydraulic fluid in the reservoir 304 is heated by passing the hydraulic fluid through the electrically controlled pressure relief valve 308. For example, energy given to the hydraulic fluid by the electrically controlled pressure relief valve 308 is equivalent to a product of a pressure difference between the low pressure line 316 and the high pressure line 314 at the input and output of the electrically controlled pressure relief valve 308, respectively and flow through the electrically controlled pressure relief valve 308. Further, the heated hydraulic fluid is stored in the reservoir 304. In one example, the electrically controlled pressure relief valve 308 can be placed close to the reservoir 304 so that heat exchange between the heated hydraulic fluid and environment is minimum.

Also in operation, the hydraulic fluid temperature control engine 320 monitors temperature of hydraulic fluid at various zones in the hydraulic circuit 302. For example, the temperature of the hydraulic fluid in the hydraulically controlled flight controls 312A-312N is monitored using temperature sensors. If the temperature of the hydraulic fluid in one or more of the hydraulically controlled flight controls 312A-312N is less than the predefined temperature, then the flushing orifices 310A-310N associated with the one or more hydraulically controlled flight control 312A-312N are opened. Further, the hydraulic pump 306 pumps the heated hydraulic fluid from the reservoir 304 to the one or more hydraulically controlled flight controls 312A-312N via the associated flushing orifices 310A-310N.

Referring now to FIG. 4, which illustrates exemplary pump characteristics 400 of the hydraulic pump 306 coupled to the reservoir 304 of the aircraft, according to one embodiment. As shown in FIG. 4, the x-axis indicates pressure and y-axis indicates flow. Particularly, the pump characteristics 400 indicates a relationship between the pump pressure setting and the flow though the pump. Further as shown in FIG. 4, point A indicates a point in the pump characteristics 400 where the pressure is minimum ($P_{min}$) and flow through the pump is maximum ($q_{max}$). Furthermore as shown in FIG. 4, point B indicates a point in the pump characteristics 400 where the pressure is maximum ($P_{max}$) and flow through the pump is 0. In addition as shown in FIG. 4, point C indicates the operating point at which the electronically controlled pressure relief valve 308 is set. The computation of the operating point is explained in detail with reference to FIG. 2.

Figure 5:
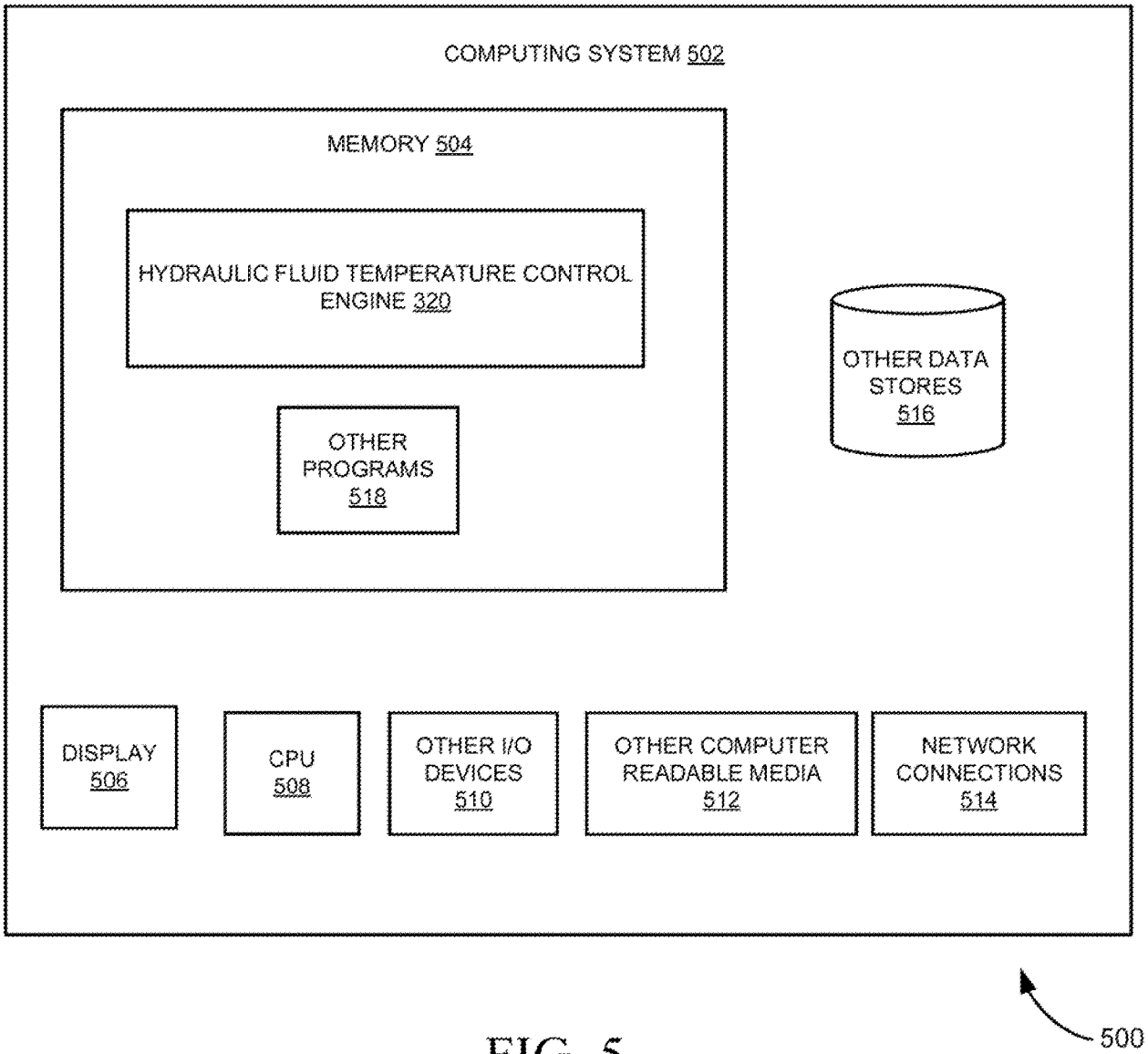
FIG. 5 illustrates a hydraulic control system including a hydraulic fluid temperature control engine for heating hydraulic fluid in the reservoir of the aircraft, using the processes described with reference to FIGS. 1 to 4, according to one embodiment.

Referring now to FIG. 5, which is a block diagram 500 of an exemplary physical computing system 502 (e.g., hydraulic control system 318 shown in FIG. 3) for implementing the hydraulic fluid temperature control engine 320, according to an embodiment. In particular, FIG. 5 shows the computing system 502 that may be utilized to implement the hydraulic fluid temperature control engine 320. Note that one or more general purpose virtual or physical computer systems suitably instructed may be used to implement the hydraulic fluid temperature control engine 320. In addition, computing system 502 may comprise one or more distinct computing systems/devices and may span distributed locations.

In the embodiment shown, computing system 502 may comprise computer memory ("memory") 504, display 506, one or more CPUs 508, input/output devices 510 (e.g., keyboard, mouse, etc.), other computer-readable media 512, and network connections 514. The hydraulic fluid temperature control engine 320 is shown residing in memory 504. The components of the hydraulic fluid temperature control engine 320 may execute on one or more CPUs 508 and implement techniques described herein. Other code or programs 518 (e.g., an administrative interface, a web server, and the like) may also reside in memory 504, and execute on one or more CPUs 508. Further, other data repositories, such as data store 516, may also reside in computing system 502. One or more of the components in FIG. 5 may not be present in any specific implementation. For example, some embodiments may not provide other computer readable media 512 and/or display 506.

The hydraulic fluid temperature control engine 320 interacts via a communication link with the electronically controlled pressure relief valve 308, shown in FIG. 3. The communication link may be any combination of media (e.g., twisted pair, coaxial, fiber optic, radio frequency). Further, the hydraulic fluid temperature control engine 320 may interact with remotely situated humans and/or devices using hardware (e.g., routers, switches, repeaters, transceivers), and protocols (e.g., TCP/IP, UDP, Ethernet, Wi-Fi, WiMAX).

In addition, programming interfaces to the data stored as part of the hydraulic fluid temperature control engine 320, such as in data store 516, can be available by standard mechanisms such as through C, C++, C #, and Java APIs; libraries for accessing files, databases, or other data repositories; through scripting languages such as XML; or through Web servers, FTP servers, or other types of servers providing access to stored data. Furthermore, in some embodiments, some or all of the components of the hydraulic fluid temperature control engine 320 may be implemented or provided in other manners, such as at least partially in firmware and/or hardware, including, but not limited to one or more application-specific integrated circuits ("ASICs"), standard integrated circuits, controllers executing appropriate instructions, and including microcontrollers and/or embedded controllers, field-programmable gate arrays ("FPGAs") complex programmable logic devices ("CPLDs"), and the like.

Some or all of the system components and/or data structures may also be stored as contents (e.g., as executable or other machine-readable software instructions or structured data) on a non-transitory computer-readable medium (e.g., as a hard disk; a memory; a computer network or cellular wireless network or other data transmission medium; or a portable media article to be read by an appropriate drive or via an appropriate connection, such as a DVD or flash memory device) so as to enable or configure the computer-readable medium and/or one or more associated computing systems or devices to execute or otherwise use or provide the contents to perform at least some of the described techniques. Some or all of the components and/or data structures may be stored on tangible, non-transitory storage mediums. Some or all of the system components and data structures may also be provided as data signals (e.g., by being encoded as part of a carrier wave or included as part of an analog or digital propagated signal) on a variety of computer-readable transmission mediums, which are then transmitted, including across wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of this disclosure may be practiced with other computer system configurations.

The systems and methods described herein enable heating hydraulic fluid in a reservoir of an aircraft at a central location. Further, the systems and methods enable maintaining the temperature of the hydraulic fluid in the reservoir at the predefined temperature.

Although the present embodiments have been described with reference to specific example embodiments, it will be evident that various modifications and changes may be made to these embodiments without departing from the broader spirit and scope of the various embodiments. Furthermore, the various devices, modules, analyzers, generators, and the like described herein may be enabled and operated using hardware circuitry, for example, complementary metal oxide semiconductor based logic circuitry, firmware, software and/or any combination of hardware, firmware, and/or software embodied in a machine readable medium. For example, the various electrical structure and methods may be embodied using transistors, logic gates, and electrical circuits, such as application specific integrated circuit.

What is claimed is:

1. A method for heating hydraulic fluid in a reservoir of an aircraft, the method comprising:

providing an electrically controlled pressure relief valve;

coupling a reservoir to the electrically controlled pressure relief valve;

coupling a hydraulic pump to the reservoir;

coupling one or more hydraulically controlled flight controls to the reservoir via the hydraulic pump;

providing a memory including a hydraulic fluid temperature control engine; and using a processor, executing the hydraulic fluid temperature control engine for:

obtaining pump characteristics of the hydraulic pump, wherein the pump characteristics include a pressure versus flow graph associated with the hydraulic pump;

determining total demand of the hydraulic fluid, wherein the total demand of the hydraulic fluid is an amount of hydraulic fluid currently utilized by the hydraulically controlled flight controls in the aircraft;

setting a designated pressure of the electrically controlled pressure relief valve based on the pump characteristics and the total demand of the hydraulic fluid; and dynamically heating the hydraulic fluid in the reservoir by passing the hydraulic fluid through the electrically controlled pressure relief valve at the designated pressure to dynamically heat the hydraulic fluid in the reservoir.

2. The method of claim 1, wherein setting the designated pressure of the electrically controlled pressure relief valve based on the pump characteristics and the total demand of the hydraulic fluid comprises:

determining a current temperature of the hydraulic fluid, a predefined temperature of the hydraulic fluid to be maintained, and a volume of the hydraulic fluid in the reservoir;

computing energy required for heating the hydraulic fluid based on the current temperature of the hydraulic fluid, the predefined temperature of the hydraulic fluid to be maintained, and the volume of the hydraulic fluid in the reservoir;

determining an operating point for the electrically controlled pressure relief valve to meet the computed energy required for heating the hydraulic fluid based on the pump characteristics and the total demand of the hydraulic fluid; and setting the designated pressure of the electrically controlled pressure relief valve based on the operating point.

3. The method of claim 2, wherein the hydraulic fluid in the reservoir is dynamically heated to the predefined temperature by passing the hydraulic fluid through the electrically controlled pressure relief valve at the designated pressure set based on the operating point.

4. An aircraft hydraulic fluid heating system comprising:

an electrically controlled pressure relief valve;

a reservoir coupled to the electrically controlled pressure relief valve;

a hydraulic pump coupled to the reservoir;

one or more hydraulically controlled flight controls coupled to the reservoir via the hydraulic pump;

memory including a hydraulic fluid temperature control engine; and a processor configured to execute the hydraulic fluid temperature control engine to:

obtain pump characteristics of the hydraulic pump, wherein the pump characteristics include a pressure versus flow graph associated with the hydraulic pump;

determine total demand of the hydraulic fluid, wherein the total demand of the hydraulic fluid is an amount of hydraulic fluid currently utilized by the hydraulically controlled flight controls in the aircraft;

set a designated pressure of the electrically controlled pressure relief valve based on the pump characteristics and the total demand of the hydraulic fluid; and dynamically heat the hydraulic fluid in the reservoir by passing the hydraulic fluid through the electrically controlled pressure relief valve at the designated pressure.

5. The aircraft hydraulic fluid heating system of claim 4, wherein the hydraulic fluid temperature control engine is configured to:

determine a current temperature of the hydraulic fluid, a predefined temperature of the hydraulic fluid to be maintained, and a volume of the hydraulic fluid in the reservoir;

compute energy required for heating the hydraulic fluid based on the current temperature of the hydraulic fluid, the predefined temperature of the hydraulic fluid to be maintained, and the volume of the hydraulic fluid in the reservoir;

determine an operating point for the electrically controlled pressure relief valve to meet the computed energy required for heating the hydraulic fluid based on the pump characteristics and the total demand of the hydraulic fluid; and set the designated pressure of the electrically controlled pressure relief valve based on the operating point.

6. The aircraft hydraulic fluid heating system of claim 5, wherein the hydraulic fluid in the reservoir is dynamically heated to the predefined temperature by passing the hydraulic fluid through the electrically controlled pressure relief valve at the designated pressure set based on the operating point.

7. A non-transitory computer-readable storage medium for operating an aircraft hydraulic fluid heating system comprising an electrically controlled pressure relief valve, a reservoir coupled to the electrically controlled pressure relief valve, a hydraulic pump coupled to the reservoir, one or more hydraulically controlled flight controls coupled to the reservoir via the hydraulic pump, the non-transitory computer-readable storage medium including instructions executable by a processor to perform steps of:

obtaining pump characteristics of a hydraulic pump coupled to a reservoir, wherein the pump characteristics include a pressure versus flow graph associated with the hydraulic pump;

determining total demand of hydraulic fluid, wherein the total demand of the hydraulic fluid is an amount of hydraulic fluid currently utilized by the hydraulically controlled flight controls in an aircraft;

setting a designated pressure of an electrically controlled pressure relief valve based on the pump characteristics and the total demand of the hydraulic fluid; and dynamically heating the hydraulic fluid in the reservoir by passing the hydraulic fluid through the electrically controlled pressure relief valve at the designated pressure.

8. The non-transitory computer-readable storage medium of claim 7, wherein setting the designated pressure of the electrically controlled pressure relief valve based on the pump characteristics and the total demand of the hydraulic fluid comprises:

determining a current temperature of the hydraulic fluid, a predefined temperature of the hydraulic fluid to be maintained, and a volume of the hydraulic fluid in the reservoir;

computing energy required for heating the hydraulic fluid based on the current temperature of the hydraulic fluid, the predefined temperature of the hydraulic fluid to be maintained, and the volume of the hydraulic fluid in the reservoir;

determining an operating point for the electrically controlled pressure relief valve to meet the computed energy required for heating the hydraulic fluid based on the pump characteristics and the total demand of the hydraulic fluid; and setting the designated pressure of the electrically controlled pressure relief valve based on the operating point.

9. The non-transitory computer-readable storage medium of claim 8, wherein the hydraulic fluid in the reservoir is dynamically heated to the predefined temperature by passing the hydraulic fluid through the electrically controlled pressure relief valve at the designated pressure set based on the operating point.

* * * * *